US011292981B2

(12) United States Patent
Li et al.

(10) Patent No.: US 11,292,981 B2
(45) Date of Patent: Apr. 5, 2022

(54) EMULSIFIER FOR LUBRICATING OIL CONCENTRATE

(71) Applicant: Huntsman Petrochemical LLC, The Woodlands, TX (US)

(72) Inventors: Xiaolong Li, Shanghai (CN); Wei-Yang Su, Spring, TX (US); Jun Fan, Shanghai (CN)

(73) Assignee: HUNTSMAN Petrochemical LLC, The Woodlands, TX (US)

( * ) Notice: Subject to any disclaimer, the term of this patent is extended or adjusted under 35 U.S.C. 154(b) by 0 days.

(21) Appl. No.: 16/358,934

(22) Filed: Mar. 20, 2019

(65) Prior Publication Data

US 2019/0218469 A1 Jul. 18, 2019

Related U.S. Application Data

(63) Continuation of application No. 14/363,355, filed as application No. PCT/CN2012/077577 on Jun. 27, 2012, now abandoned.

(51) Int. Cl.

| | |
|---|---|
| ***C10M 133/08*** | (2006.01) |
| ***C10M 173/00*** | (2006.01) |
| ***C10N 30/12*** | (2006.01) |
| ***C10N 30/18*** | (2006.01) |
| ***C10N 30/00*** | (2006.01) |
| ***C10N 40/20*** | (2006.01) |
| ***C10N 70/00*** | (2006.01) |

(52) U.S. Cl.

CPC ..... *C10M 133/08* (2013.01); *C10M 173/00* (2013.01); *C10M 2201/087* (2013.01); *C10M 2203/1006* (2013.01); *C10M 2203/1025* (2013.01); *C10M 2203/1045* (2013.01); *C10M 2203/1065* (2013.01); *C10M 2203/1085* (2013.01); *C10M 2207/126* (2013.01); *C10M 2207/40* (2013.01); *C10M 2215/04* (2013.01); *C10M 2215/042* (2013.01); *C10M 2219/044* (2013.01); *C10N 2030/12* (2013.01); *C10N 2030/18* (2013.01); *C10N 2030/24* (2020.05); *C10N 2040/20* (2013.01); *C10N 2070/02* (2020.05)

(58) Field of Classification Search

CPC ..... C10M 133/08; C10M 173/00; C10M 2201/087; C10M 2203/1025; C10M 2203/1045; C10M 2203/1065; C10M 2203/1085; C10M 2207/126; C10M 2207/04; C10M 2215/042; C10M 2219/044

See application file for complete search history.

(56) References Cited

U.S. PATENT DOCUMENTS

| | | | | | |
|---|---|---|---|---|---|
| 3,840,611 | A * | 10/1974 | Gau | C07C 7/173 | 585/853 |
| 4,118,331 | A * | 10/1978 | Jahnke | C10M 141/10 | 508/306 |
| 4,268,404 | A * | 5/1981 | Ahlgrim | C10M 125/24 | 508/162 |
| 4,402,844 | A * | 9/1983 | Trepka | C08C 19/42 | 508/243 |
| 6,271,185 | B1 * | 8/2001 | Kodali | C10M 105/00 | 508/487 |
| 6,548,456 | B1 * | 4/2003 | Mulder | C10M 133/44 | 508/268 |
| 6,617,303 | B1 * | 9/2003 | Smith | C11D 1/44 | 510/336 |
| 2006/0270569 | A1 * | 11/2006 | Athans | C10M 173/00 | 508/491 |
| 2010/0093868 | A1 * | 4/2010 | Kadokawa | A01N 33/04 | 514/671 |
| 2010/0222618 | A1 * | 9/2010 | Takagi | C10M 105/04 | 585/1 |

OTHER PUBLICATIONS

Huntsman Performance Products Metalworking Chemicals, Americas Product Information Brochure, retrieved from the internet at <http://web.archive.org/web/20081204095243/http://www.huntsman.com/performance_products/Media/MW_Americas_Product_Information.pdf> on Aug. 15, 2019 (Year: 2008).*

* cited by examiner

*Primary Examiner* — James C Goloboy
(74) *Attorney, Agent, or Firm* — Huntsman Petrochemical LLC; Aleece M. Hayes

(57) ABSTRACT

The present disclosure provides a lubricating oil concentrate containing an ethoxylated ether amine and a base oil. The lubricating oil concentrate is capable of forming a stable, low foaming emulsion when added to an aqueous medium and may be useful in metalworking and cleaning fluids.

8 Claims, No Drawings

EMULSIFIER FOR LUBRICATING OIL CONCENTRATE

CROSS REFERENCE TO RELATED APPLICATIONS

This application is a continuation application of U.S. patent application Ser. No. 14/363,355, filed Aug. 25, 2014, which is the National Phase of International Application PCT/CN2012/077577 filed Jun. 27, 2012 which designated the United States. The noted applications are incorporated herein by reference.

FIELD

The present disclosure is directed to an ethoxylated ether amine useful in preparing water-miscible concentrates of lubricating oils, to such concentrates and to aqueous emulsions obtained therefrom.

BACKGROUND

Metalworking fluids are used throughout industry in a variety of metalworking processes such as rolling, stamping, drawing, pickling, cutting, extruding and forming of metal. The fluids act by cooling and lubricating the metal-tool interface while flushing the fines or chips of metal away from the work piece.

Included among metalworking fluids are: straight oils, soluble oils, semi-synthetics and synthetics. Straight oils, also called "cutting" or "neat" oils, are made up of a base oil, such as a mineral (petroleum), animal, vegetable or synthetic oil. Soluble oils contain a base oil (e.g. about 30-85 weight percent of base oil) while semi-synthetics, which are similar to soluble oils, contain lesser amounts of base oil (e.g. about 5-30% weight percent of base oil). Synthetics do not contain base oil, but instead use detergent-like components.

General requirements for satisfactory metalworking fluid use include: good lubrication; effective cooling; emulsion stability and clarity under operating conditions; and corrosion inhibiting properties. Other considerations include cost and environmental factors and worker safety issues due to, for example, misting or foaming during use.

Various metalworking fluids and additives, for example emulsifiers, used in connection thereof can be found in:

WO 93/02164, which describes an oil-free metalworking fluid in the form of a microemulsion that includes a water-insoluble soluble polyalkylene oxide alcohol and a water-soluble phosphate emulsifier;

WO 98/50139, which teaches a surfactant used to prepare a microemulsion of an oil-in-water metalworking fluid that contains a fatty acid amine ethoxylate an alcohol ethoxylate and a tall oil fatty acid amine;

U.S. Pat. No. 6,020,291, which discloses a metalworking fluid comprising water, a mist copolymer and an oil;

U.S. Pat. No. 6,225,267, which teaches a cutting fluid for metalworking containing petroleum oil and a sodium sulfonate emulsifier blend;

U.S. Pat. No. 7,008,909, which is directed to a metalworking fluid containing water, an alpha branched ester and an oil;

US 2006/0270569, which discloses an emulsion containing an oil component, a surfactant and water for use in lubricant applications;

US 2006/0111252, which describes emulsifier blends containing alkali metal sulfonates and salicylates and their use in metalworking fluids; and US 2011/0162425, which teaches alkoxylated fatty alcohol emulsifiers and their use in combination with oil and water in metalworking fluids.

SUMMARY

The present disclosure relates to a water-miscible lubricating oil concentrate which contains (i) an ethoxylated ether amine having the formula (I)

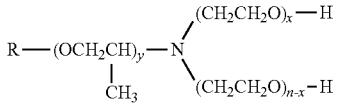

(I)

where R=a straight chain or branched alkyl group having from 8 to 22 carbon atoms;

n=an integer from 2 to 30;

x=an integer from 1 to 29; and y=an integer from 1 to 30; and (ii) a base oil.

In a further embodiment, the present disclosure provides an aqueous emulsion containing an oil phase dispersed in a continuous aqueous medium where the oil phase contains the lubricating oil concentrate and the aqueous medium contains water. The aqueous emulsion is stable and low foaming and may be used in a variety of applications, such as in metalworking or cleaning fluids.

DETAILED DESCRIPTION

If appearing herein, the term "comprising" and derivatives thereof are not intended to exclude the presence of any additional component, step or procedure, whether or not the same is disclosed herein. In order to avoid any doubt, all compositions claimed herein through use of the term "comprising" may include any additional additive, adjuvant, or compound, unless stated to the contrary. In contrast, the term, "consisting essentially of" if appearing herein, excludes from the scope of any succeeding recitation any other component, step or procedure, excepting those that are not essential to operability and the term "consisting of", if used, excludes any component, step or procedure not specifically delineated or listed. The term "or", unless stated otherwise, refers to the listed members individually as well as in any combination.

The articles "a" and "an" are used herein to refer to one or to more than one (i.e. to at least one) of the grammatical object of the article. By way of example, "a resin" means one resin or more than one resin.

The phrases "in one embodiment," "according to one embodiment," and the like generally mean the particular feature, structure, or characteristic following the phrase is included in at least one embodiment of the present invention, and may be included in more than one embodiment of the present invention. Importantly, such phrases do not necessarily refer to the same embodiment.

If the specification states a component or feature "may", "can", "could", or "might" be included or have a characteristic, that particular component or feature is not required to be included or have the characteristic.

The present invention generally provides a water-miscible lubricating oil concentrate containing an ethoxylated ether amine and a base oil. It has been surprisingly found that combination of these two components, when added to an aqueous medium, produces an aqueous emulsion that exhibits improved stability, good wetting and low foaming properties while also being environmentally friendly.

According to one embodiment, the ethoxylated ether amine is a compound represented by the formula (I)

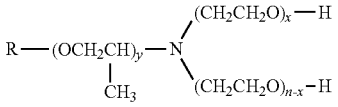

(I)

where R=a straight chain or branched alkyl group having from 8 to 22 carbon atoms;

n=an integer from 2 to 30;

x=an integer from 1 to 29; and y=an integer from 1 to 30.

In one embodiment, the ethoxylated ether amine is a compound represented by the formula (I) where R=a straight chain or branched alkyl group having from 10 to 18 carbon atoms, preferably from 12 to 16 carbon atoms.

In another embodiment, the ethoxylated ether amine is a compound represented by the formula (I) where y=an integer from 1 to 20, preferably from 2 to 6 and more preferably from 2 to 3.

In still another embodiment, the ethoxylated ether amine is a compound represented by the formula (I) where n=an integer from 5 to 20 and x=an integer from 4 to 19. In a further embodiment, the ethoxylated ether amine is a compound represented by the formula (I) where n+x=4 to 10, preferably 5.

In some embodiments, the ethoxylated ether amine of formula (I) may be present in the oil concentrate in an amount of about 1% by weight to about 90% by weight, based on the total weight of the oil concentrate. In another embodiment, the ethoxylated ether amine of formula (I) may be present in the oil concentrate in an amount of about 2% by weight to about 50% by weight, based on the total weight of the oil concentrate. In still another embodiment, the ethoxylated ether amine of formula (I) may be present in the oil concentrate in an amount of about 5% by weight to about 20% by weight, based on the total weight of the oil concentrate.

The oil concentrate of the present disclosure also includes a base oil. In some embodiments, the base oil will have a kinematic viscosity in the range of from about 1 cSt to about 1000 cSt at a temperature of 40° C. In one particular embodiment, the base oil is a petroleum-based oil, vegetable oil, animal-derived oil or synthetic oil.

Examples of petroleum-based oils which may be used in the present disclosure include, but are not limited to, naphthalenic oils, paraffinic oils, crude oils, diesel oils, mineral seal oils, kerosenes, fuel oils, white oils and aromatic oils.

Examples of vegetable oils or animal-derived oils include, but are not limited to, canola oil, walnut oil, cashew nut oil, olive oil, corn oil, peanut oil, grape seed oil, oiticia oil, palm oil, rapseed oil, fish oil, fish liver oil, sperm oil, oleic acid, bear oil, whale oil, and linseed oil.

Examples of synthetic oils include, but are not limited to, hydrocarbon oils and halo-substituted hydrocarbon oils such as polymerized and interpolymerized olefins, for example polybutylenes, polypropylenes, propylene-isobutylene copolymers, chlorinated polybutylenes, poly(1-hexenes), poly(1-octenes), poly(1-decenes); alkyl benzenes, such as dodecylbenzenes, tetradecylbenzenes, dinonylbenzenes, di-(2-ethylhexyl)benzenes; polyphenyls such as biphenyls, terphenyls, and alkylated polyphenyls; and alkylated diphenyl ethers and alkylated diphenyl sulfides and derivatives, analogs and homologs thereof. Alkylene oxide polymers and derivatives thereof where terminal hydroxy groups have been modified by esterification, etherification etc. constitute another class of synthetic oils. These are exemplified by polyoxyalkylene polymers prepared by the polymerization of ethylene oxide or propylene oxide, the alkyl and aryl ethers of these polyoxyalkylene polymers such as methylpolyisopropylene glycol ethers, diphenyl and diethyl ethers of polyethylene glycol; and mono and polycarboxylic esters thereof, for example, the acetic esters, mixed $C_3$-$C_8$ aliphatic acid esters, $C_{12}$-$C_{22}$ fatty acid esters, and $C_{13}$ oxo diester of tetraethylene glycol. Simple aliphatic ethers may be used as synthetic oils, such as, dioctyl ether, didecyl ether, di(2-ethylhexyl) ether. Other synthetic oils comprise the esters of fatty acids such as ethyl oleate, lauryl hexanoate, and decyl palmitate and the esters of dicarboxylic acids such as phthalic acid, succinic acid, maleic acid, azelaic acid, sebacic acid, fumaric acid, adipic acid, linoleic acid dimer, malonic acid, alkyl malonic acids, alkenyl malonic acids with a variety of alcohols such as butyl alcohol, hexyl alcohol, dodecyl alcohol, 2-ethylhexyl alcohol, ethylene glycol, diethylene glycol monoethyl ether, propylene glycol are also useful. Specific examples of these esters include dibutyl adipate, di(2-ethylhexyl) sebacate, di-n-hexyl fumarate, dioctyl sebacate, diisoctyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethyl-hexanoic acid. and polyalphaolefins.

In still another embodiment, the base oil is a mixture of at least two of the oils described above.

According to some embodiments, the base oil may be present in the oil concentrate in an amount of about 0.5% by weight to about 97.5% by weight, based on the total weight of the oil concentrate. In another embodiment, the base oil may be present in the oil concentrate in an amount of about 5% by weight to about 95% by weight, based on the total weight of the oil concentrate. In other embodiments, the base oil is present in the oil concentrate in an amount greater than about 40% by weight, based on the total weight of the oil concentrate. In further embodiments, the base oil is present in the oil concentrate in an amount less than about 40% by weight, based on the total weight of the oil concentrate. In still other embodiments, the base oil is present in the oil concentrate in an amount of about 30% by weight to about 85% by weight, based on the total weight of the oil concentrate while in other embodiments, the base oils is present in the oil concentrate in an amount of about 5% by weight to about 30% by weight, based on the total weight of the oil concentrate.

Optionally, the water-miscible lubricating oil concentrate may contain one or more additives. Such additives include, but are not limited to: corrosion inhibitors, such as alkaline and alkanolamine salts of organic acids, sulfonates, amines, amides, and organic borate compounds; biocides, such as o-phenylphenol; bactericides, fungicides and algaecides; colorants; fragrances; surfactants; chelating agents; pH buffering agents; solubilizers, anti-oxidants; anti-foaming agents; extreme pressure agents; and mixtures thereof.

The water-miscible lubricating oil concentrate may be prepared by admixing the ethoxylated ether amine with the base oil such that upon its addition to an aqueous medium, for example water, a stable, low foaming aqueous emulsion results. The water-miscible lubricating oil concentrate may be used "as-is" or may be diluted with water or other aqueous solution prior to addition to the aqueous medium. Thus, in another embodiment, water is added to the water-miscible oil concentrate to dilute the oil concentrate of the present disclosure and the oil concentrate is then added to the aqueous medium to form a stable, low foaming aqueous emulsion. In a further embodiment, the water and/or aqueous medium is deionized water.

As noted above, the water-miscible lubricating oil concentrate of the present disclosure, upon addition to an aqueous medium, forms a stable, low foaming aqueous emulsion which may be used in many applications, such as metalworking fluids for metalworking processes. In addition, the aqueous emulsion exhibits surprisingly good wetting properties and non ferrous metal protection and may also be used in cleaning fluids. Aqueous emulsions of the oil-in-water and water-in-oil type may be formed with the addition of from about 1 weight part to about 40 weight parts, preferably from about 2 weight parts to about 30 weight parts, and more preferably from about 5 weight parts to about 20 weight parts of lubricating oil concentrate per 100 weight parts of aqueous medium. In most embodiments, the aqueous medium is water, preferably deionized water.

Thus, in another embodiment, there is provided a metalworking or cleaning fluid comprising an aqueous emulsion wherein the aqueous emulsion includes an oil phase dispersed in a continuous aqueous medium, the oil phase containing the lubricating oil concentrate and the aqueous medium containing water.

Metalworking processes where the metalworking fluid may be used include, but are not limited to, elastic deformation, plastic deformation and cold working of metals, with or without metal removal. In some of these operations the metal piece is deformed only; like in rolling, drawing, stamping, forging and blanking of steel and aluminum, while in others metal is removed rather than deformed, like in cutting, grinding, turning, milling, tapping, broaching, machining and drilling of metals. The metallic material from which the metalworking apparatus and articles to be fabricated are made, include steel, cast iron, and ferrous alloys, as well as aluminum alloys and other non-ferrous alloys, including such components as titanium, magnesium, copper, tin and brass.

In one particular embodiment, the water-miscible lubricating oil concentrate may be used in a cutting process. A lubricating oil concentrate formulation dispersed in an aqueous medium at a concentration of about 5 weight parts to 20 weight parts of oil concentrate per 100 weight parts of aqueous medium (for e.g. water) may include the following:

| Oil Concentrate Components | Wt. % based on the total weight of oil concentrate |
|---|---|
| Paraffinic Oil | 60 to 70 |
| Ethoxylated ether amine | 10 to 18 |
| Diglycolamine | 3 to 6 |
| Inorganic Acid | 1 to 4 |
| Organic Acid | 1 to 2 |
| Stabilizer | 2 to 4 |
| Tall Oil Fatty Acid | 6 to 10 |
| Deionized Water | 0.5 to 3 |

In another embodiment, the water-miscible lubricating oil concentrate may be used for an aluminum cutting or grinding process. A lubricating oil concentrate formulation for an aluminum cutting or grinding process dispersed in an aqueous medium at a concentration of about 5 weight parts to about 20 weight parts of oil concentrate per 100 parts of aqueous medium (for e.g. water) may include the following:

| Oil Concentrate Components | Wt. % based on the total weight of the oil concentrate |
|---|---|
| Paraffinic Oil | 10 to 20 |
| Ethoxylated ether amine | 10 to 20 |
| Nonionic Surfactants | 5 to 15 |
| Tall Oil | 6 to 10 |
| Stabilizer | 1 to 3 |
| Diglycolamine | 5 to 10 |
| Inorganic Acid | 3 to 5 |
| Organic Acid | 1 to 3 |
| Amine | 0.2 to 0.6 |
| Deionized Water | Balance to 100 |

The following examples are provided to illustrate embodiments of the present disclosure but are not intended to limit the scope thereof.

Example 1

Emulsifying properties and foam resistance were evaluated for four different commercially available sodium sulfonate (M, H, HL, and L) emulsifiers and an ethoxylated ether amine according to the present disclosure (Surfonic® PEA-25 emulsifier available from Huntsman Petrochemical LLC). The oil concentrates were prepared by adding each emulsifier at various dosages (5 wt. %, 8 wt. %, and 12 wt. % of emulsifier, based on the total weight of the oil concentrate) to a base oil (paraffin-base oil).

5.0 grams of the resulting oil concentrate and 95.0 grams of deionized water were then added to a graduated cylinder. The cylinder was stoppered, shook, and various properties were then measured. The results are given below in Table 1 through 3.

Materials Used for Example 1

| Emulsifier | Sodium Sulfonate | | | |
|---|---|---|---|---|
| Material Name | Aristonate ® M | Aristonate ® H | Petronate ® HL | Petronate ® L |
| Average Molecular Weight | 430 | 460 | 450 | 420 |
| Material Type | Synthetic | | Natural | |
| Supplier | Pilot Chemical Co. | | Sonneborn Inc. | |

| | Paraffin-base oil |
|---|---|
| Material Name | HVI Ia 150 (150N Paraffinic Oil) |
| Viscosity (40° C.), mm2/s | 28.00-32.00 |
| Supplier | Sinopec |

TABLE 1

| Performance Comparison with Emulsifier Dosage at 5 wt % | | | | | |
|---|---|---|---|---|---|
| | Formulation | | | | |
| | A | B | C | D | E |
| Material | Weight, % | | | | |
| 150SN | 95 | 95 | 95 | 95 | 95 |
| PEA 25 | 5 | | | | |
| M | | 5 | | | |
| H | | | 5 | | |
| HL | | | | 5 | |
| L | | | | | 5 |
| Test Results | | | | | |
| | Foam Resistance(cm) | | | | |
| Start | 4.3 | 8.5 | 9.0 | 5.8 | 6.5 |
| 5 min later | 3.0 | 8.0 | 8.5 | 5.0 | 6.0 |
| | Emulsifying Properties, Cream Volume, ml | | | | |
| 3 min | 1.5 | 6.0 | 8.5 | 7.0 | 1.5/4.5(Oil/Cream) |
| 15 min | 2.0 | 8.5 | 9.5 | 9.0 | 2.0/5.5(Oil/Cream) |

TABLE 2

| Performance Comparison with Emulsifier Dosage at 8% | | | | | |
|---|---|---|---|---|---|
| | Formulation | | | | |
| | F | G | H | I | J |
| Material | Weight, % | | | | |
| 150SN | 92 | 92 | 92 | 92 | 92 |
| PEA 25 | 8 | | | | |
| M | | 8 | | | |
| H | | | 8 | | |
| HL | | | | 8 | |
| L | | | | | 8 |
| Test Results | | | | | |
| | Foam Resistance(cm) | | | | |
| Start | 4.8 | 9.0 | 6.5 | 6.8 | 6.5 |
| 5 min later | 3.8 | 8.5 | 6.0 | 6.5 | 6.2 |
| | Emulsifying Properties, Cream Volume, ml | | | | |
| 3 min | 0.2 | 3.0 | 3.0 | 6.0 | 5.0 |
| 15 min | 1.0 | 8.0 | 7.5 | 5.0 | 4.5 |

TABLE 3

| Performance Comparison with Emulsifer Dosage at 12% | | | | | |
|---|---|---|---|---|---|
| | Formulation | | | | |
| | K | L | M | N | O |
| Material | Weight, % | | | | |
| 150SN | 88 | 88 | 88 | 88 | 88 |
| PEA 25 | 12 | | | | |
| M | | 12 | | | |
| H | | | 12 | | |
| HL | | | | 12 | |
| L | | | | | 12 |
| Test Results | | | | | |
| | Foam Resistance(cm) | | | | |
| Start | 4.5 | 8.0 | 5.5 | 8.0 | 9.0 |
| 5 min later | 3.0 | 7.0 | 4.5 | 6.5 | 8.5 |
| | Emulsifying Properties, Cream Volume, ml | | | | |
| 3 min | 0.0 | 1.5 | 2.0 | 0.5 | 0.2 |
| 15 min | 0.1 | 5.5 | 9.0 | 2.5 | 2.5 |

Example 2

Soluble Oil Formulation

The following oil concentrate formulation at about 5 weight parts to 10 weight parts per 100 parts of oil concentrate per 100 weight parts water was prepared. The emulsions performance was then measured and the results are provided in Table 4 below:

TABLE 4

| Oil Concentrate Components | Wt. % based on the total weight of oil concentrate |
|---|---|
| 150N Paraffinic Oil | 65% |
| Diglycolamine | 4.7% |
| Boric Acid | 2.6% |
| Caprylic Acid | 1.4% |
| Surfonic ® WT-2524 | 3% |
| Surfonic ® PEA 25 | 14% |
| Tall Oil Fatty Acid | 8% |
| Deionized Water | 1.3% |
| Test Results | |
| Appearance(Concentrate) | clear |
| Concentrate Stability | |
| High Temp@50° C., 4 H | clear |
| Appearance (Emulsion @ 5%) | Milky white |
| pH @ 5% | 9.05 |
| Emulsion Stability @ 5%, 25° C. | Oil/Cream, ml |
| 200 ppm Hard Water | none/Trace |
| 400 ppm Hard Water | none/0.1 |

Semi-Synthetic Fluid Formulation

The following oil concentrate at about 5 weight parts to 20 weight parts of oil concentrate per 100 weight parts water provides excellent emulsion stability. No aluminum staining was observed.

| Oil Concentrate Components | Wt. % based on the total weight of the oil concentrate |
|---|---|
| 150N Paraffinic Oil | 15% |
| Surfonic ® PEA 25 | 15% |
| Surfonic ® L4-2 | 2% |
| Tall Oil | 8% |
| Surfonic ® WT-2524 | 2% |
| Diglycolamine | 7.5% |
| Boric Acid | 4.2% |
| Caprylic Acid | 2.3% |
| Surfonic ® POA-17R2 | 1.6% |
| Surfonic ® POA-17R4 | 1.6% |
| Jeffamine ® T-403 | 0.4% |
| Teric 12A3 Surfactant | 5% |
| Deionized Water | 35.4% |
| Test Results | |
| Appearance(Concentrate) | clear |
| Concentrate Stability | |
| High Temp@50° C., 4 H | clear |
| Appearance (Emulsion, 5%) | translucent |
| pH @ 5% | 9.42 |
| Emulsion Stability @ 5%, ambient temperature | Oil/Cream, ml |
| 200 ppm Hard Water | none/none |
| 400 ppm Hard Water | none/none |
| Aluminum Stain Test @ 5% (24 hr immersion, ambient temperature): | |
| 7075Al | No stain |
| 6061Al | No stain |

-continued

| Oil Concentrate Components | Wt. % based on the total weight of the oil concentrate |
|---|---|
| 3191Al | No stain |
| 2024Al | No stain |
| Rust Protection Test@2% | |
| Chip rust @ rust area %, DI-Water | 0% |
| Chip rust @ rust area %, 200 ppm Hard Water | 25% |

Consideration must be given to the fact that although this disclosure has been described and disclosed in relation to certain preferred embodiments, obvious equivalent modifications and alterations thereof will become apparent to one of ordinary skill in this art upon reading and understanding this specification and the claims appended hereto. The present disclosure includes the subject matter defined by any combination of any one of the various claims appended hereto with any one or more of the remaining claims, including the incorporation of the features and/or limitations of any dependent claim, singly or in combination with features and/or limitations of any one or more of the other dependent claims, with features and/or limitations of any one or more of the independent claims, with the remaining dependent claims in their original text being read and applied to any independent claim so modified. This also includes combination of the features and/or limitations of one or more of the independent claims with the features and/or limitations of another independent claim to arrive at a modified independent claim, with the remaining dependent claims in their original text being read and applied to any independent claim so modified. Accordingly, the presently disclosed invention is intended to cover all such modifications and alterations, and is limited only by the scope of the claims which follow, in view of the foregoing and other contents of this specification.

What is claimed is:

1. An aqueous emulsion consisting of:

about 5 to about 20 weight parts of a water-miscible lubricating oil concentrate consisting of:

(i) from about 10% by weight to about 20% by weight, based on the total weight of the water-miscible lubricating oil concentrate, of an ethoxylated ether amine having the formula (I)

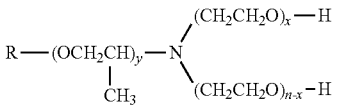

where R=a straight chain or branched alkyl group having from 8 to 22 carbon atoms;

n=an integer from 2 to 30;

x=an integer from 1 to 29; and y=an integer from 1 to 30; and (ii) greater than about 40% by weight, based on the total weight of the water-miscible lubricating oil concentrate, of a base oil consisting of a petroleum-based oil and a second petroleum-based oil; and optionally (iii) at least one of a corrosion inhibitor, a o-phenylphenol, a colorant, a fragrance, a surfactant, a pH buffering agent, a solubilizer, an anti-oxidant, an anti-foaming agent, an extreme pressure agent, and water; and 100 weight parts of water.

2. The aqueous emulsion of claim 1, wherein R=a straight chain or branched alkyl group having from 12 to 16 carbon atoms.

3. The aqueous emulsion of claim 1, wherein y=an integer from 2 to 6.

4. The aqueous emulsion of claim 1, wherein n=an integer from 5 to 20 and x=an integer from 4 to 19.

5. The aqueous emulsion of claim 1, wherein the petroleum-based oil is selected from naphthalenic oil, paraffinic oil, crude oil, diesel oil, mineral seal oil, kerosene, fuel oil, white oil, and aromatic oil.

6. The aqueous emulsion of claim 1, wherein the water-miscible lubricating oil concentrate further comprises a surfactant and/or water.

7. A method of preparing an aqueous emulsion consisting of:

about 5 to about 20 weight parts of a water-miscible lubricating oil concentrate consisting of admixing about 10% by weight to about 20% by weight, based on the total weight of the water-miscible lubricating oil concentrate, ethoxylated ether amine having the formula (I)

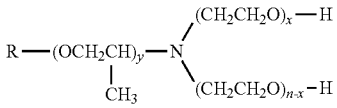

where R=a straight chain or branched alkyl group having from 8 to 22 carbon atoms;

n=an integer from 2 to 30;

x=an integer from 1 to 29; and y=an integer from 1 to 30, with greater than about 40% by weight, based on the total weight of the water-miscible lubricating oil concentrate, of a base oil consisting of a petroleum-based oil and a second petroleum-based oil, and optionally at least one of a corrosion inhibitor, o-phenylphenol, a colorant, a fragrance, a surfactant, a pH buffering agent, a solubilizer, an anti-oxidant, an anti-foaming agent, an extreme pressure agent, and water; and 100 weight parts of water.

8. A metal working or cleaning fluid consisting of an aqueous emulsion wherein the aqueous emulsion consists of an oil phase dispersed in a continuous aqueous medium, the oil phase consisting of about 5 to about 20 weight parts of a water-miscible lubricating oil concentrate of:

(i) from about 10% by weight to about 20% by weight, based on the total weight of the water-miscible lubricating oil concentrate, of an ethoxylated ether amine having the formula (I)

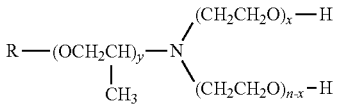

where R=a straight chain or branched alkyl group having from 8 to 22 carbon atoms;

n=an integer from 2 to 30;

x=an integer from 1 to 29; and y=an integer from 1 to 30; and (ii) greater than about 40% by weight, based on the total weight of the water-miscible lubricating oil concentrate, of a base oil consisting of a petroleum-based oil and a second petroleum-based oil;

the aqueous medium consisting of 100 weight parts of water.

* * * * *